United States Patent [19]

Conti

[11] 3,952,901

[45] Apr. 27, 1976

[54] TAMPER-PROOF OVERCAP CONSTRUCTION

[75] Inventor: Vincent N. Conti, West Hempstead, N.Y.

[73] Assignee: Dairy Cap Corporation, Jamaica, N.Y.

[22] Filed: Jan. 27, 1975

[21] Appl. No.: 544,518

Related U.S. Application Data

[63] Continuation-in-part of Ser. No. 485,081, July 2, 1974, abandoned.

[52] U.S. Cl. ..... 215/251; 215/254; 215/274

[51] Int. Cl.[2] ..... B65D 41/62; B65D 51/18

[58] Field of Search ..... 215/251–254, 7, 274; 220/257, 266, 220

[56] References Cited

UNITED STATES PATENTS

| | | | |
|---|---|---|---|
| 2,162,754 | 6/1939 | Schauer | 215/251 X |
| 3,656,648 | 4/1972 | Powaloski et al. | 215/274 X |
| 3,823,841 | 7/1974 | Lovejoy | 215/251 |

*Primary Examiner*—George T. Hall
*Attorney, Agent, or Firm*—Pennie & Edmonds

[57] ABSTRACT

An overcap for receipt on a jar in surrounding relation to a threaded closure cap of the jar and which when mounted prevents tampering with the closure cap and unauthorized entry into the jar interior. The overcap includes an upper surface overlying the closure cap and a skirt depending circumferentially therefrom. The skirt is radially spaced from the closure cap substantially along its length so that the overcap is free for rotational movement relative to the closure cap and cannot be frictionally coupled to the closure cap to effect removal of the latter. The overcap is provided with a pull tab defined by lines of weakness in the upper surface and skirt so that a pulling force on the tab will fracture the overcap from the closure cap and permit authorized access to the cap and opening of the jar.

14 Claims, 6 Drawing Figures

TAMPER-PROOF OVERCAP CONSTRUCTION

CROSS-REFERENCE TO RELATED APPLICATIONS

The present application is a continuation-in-part of application Ser. No. 485,081, filed on July 2, 1974; now abandoned.

BACKGROUND OF THE INVENTION

There have been many attempts in the prior art by those in the packaging industry, for example, to develop a structure for enveloping the closure of a container such as a bottle, jar or similar enclosure with an overcap as a preventative against unauthorized tampering of the contents sealed within the container. Such closures have taken various forms. One form generally may be characterized as a safety closure for purposes, among others, of childproofing the contents of the enclosure.

U.S. Pat. No. 3,027,035 to Farago illustrates a container in the form of a bottle having a safety closure formed by a cap which is threaded on the neck of the bottle and a cover which is received over the cap. The cover is permanently attached to the cap by bending on edge of its depending skirt around the lower edge of the cap. The cover is formed as a relatively thin casing and normally is freely rotatable relative to the cap. However, when the contents of the bottle are desired to be dispensed the cover is gripped and compressively deformed around the cap so that the two components of the safety closure may be rotated together. The safety closure again may be mounted on the bottle, the cover returning to the non-deformed condition after the safety closure is released upon completion of threading movement.

As may be appreciated, this type of structure is not tamperproof in the sense of precluding unauthorized opening of the container. To the contrary, it may be opened by merely compressing one component of the safety closure into frictional engagement with the other component. Upon reclosure, no telltale sign shows that the bottle has been opened.

Other forms of tamper-proof structure are known to those in the art, as for example, the closure structure illustrated by U.S. Pat. No. 2,162,754 to Schauer. This form of closure is relatively complex in construction and requires a container having a shoulder within the region of the neck to cooperate with a lower frangible portion of the closure. Also, the Schauer container must be particularly constructed to provide the necessary cooperating structure required for display of the tamper-proof feature.

SUMMARY OF THE INVENTION

The present invention is directed to a tamper-proof overcap structure of unique construction which provides a telltale sign of tampering and has universal application to containers of conventional construction. The overcap is relatively simple in construction, inexpensive to manufacture, and readily removable when authorized opening to the container is required.

The overcap includes a body having an upper surface and a skirt which depends circumferentially from the upper surface. A plurality of inwardly directed lip projections are formed at the lower edge of the skirt portion to cooperate with the jar surface and to engage under the rim of the closure cap when the overcap is received on the jar over the closure cap. The overcap is formed of plastic material of limited stretchability to permit initial receipt of the overcap on the jar but prevent subsequent disengagement from the jar without fracture. The overcap is formed with a central opening in the top surface of a size in a ratio to the overall diameter of the upper surface to introduce the degree of stretchability required to permit attachment to the overcap on the jar to envelop the closure cap.

The overcap is attached to the container for free rotational movement relative to the closure cap so that removal of the closure cap by untwisting is prevented. For this purpose, the skirt of the overcap is spaced from the closure cap and the overcap is of sufficient strength so that the walls of the skirt will remain spaced from the closure cap to prevent frictional coupling of the cap and overcap. This coupling is further prevented by constructing the overcap of smooth, slippery material to reduce friction at any point of engagement of the overcap with the closure cap. Also, the lip projections at the bottom edge of the skirt act to bear against the jar to assist in maintaining the spacing between the inner surface of the skirt and the outer surface of the closure cap.

A pull tab is formed integrally with the annular surface, and the body surfce includes lines of weakness formed by spaced grooves extending from the tab. The grooves permit fracture of the body for removal of the overcap from the closure cap when the tab is lifted and pulled. Also, the grooves extend along both the upper surface of the overcap and along the skirt and are more deeply formed in the region of the lower edge of the skirt to better assure that fracture of the overcap results from unauthorized tampering.

DESCRIPTION OF THE PREFERRED EMBODIMENT

Figure 1:
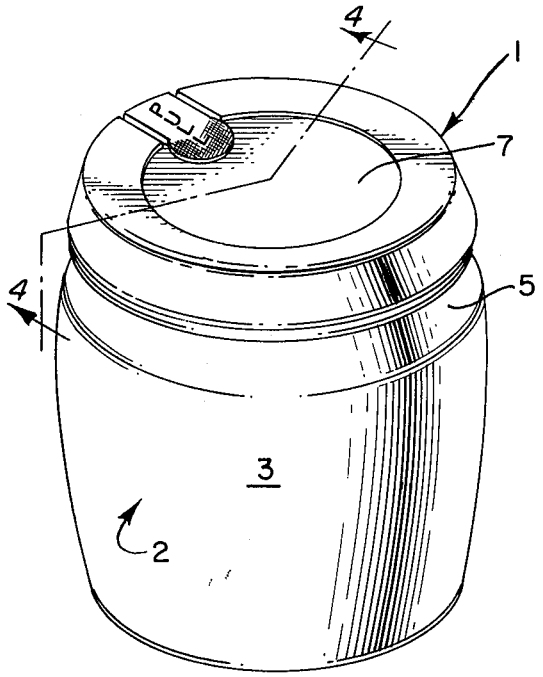
FIG. 1 is a perspective view of the overcap of the present invention mounted on a jar in surrounding relation to a closure cap.
Figure 2:
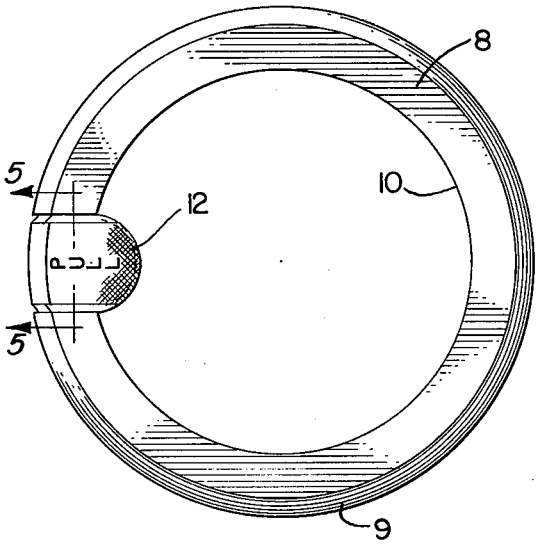
FIG. 2 is a top plan view of the overcap of FIG. 1.
Figure 4:
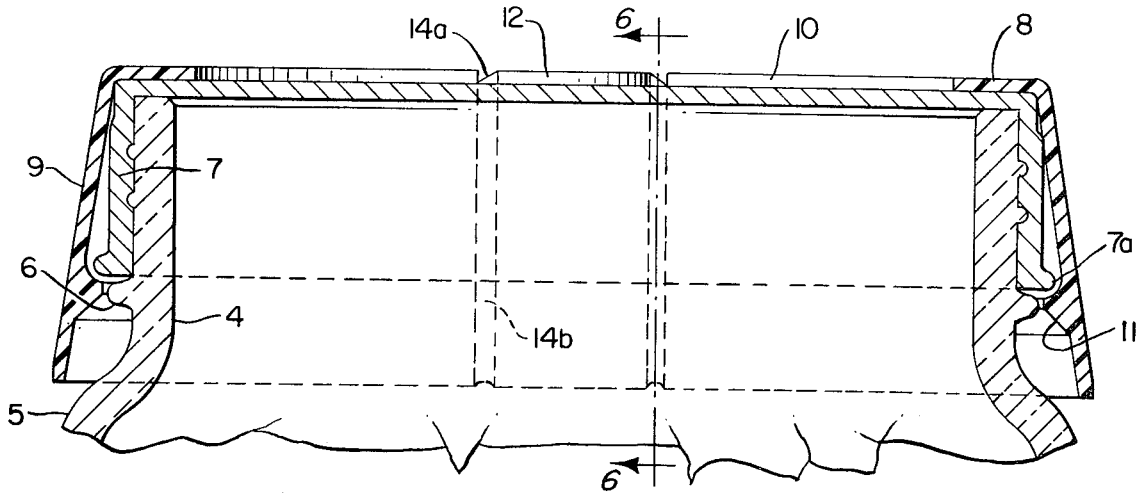
FIG. 4 is a vertical section view as seen along the line 4—4 in FIG. 1.

The overcap 1 of the present invention is mounted in engaged position on a jar 2 to envelop an underlying cap as may be seen to best advantage in FIGS. 1 and 4. The jar includes a body 3, a neck 4 and a shoulder 5 providing a rounded transition between the neck and body. The neck defines an opening for access to the jar contents and is provided with a thread on the outer surface throughout a portion of its length. A bumper roll 6, formed as a generally rounded, circumferential outward projection, extends around the lower neck below the region of the thread. A closure cap 7 of conventional construction and preferably formed of metal is threadedly received on the neck of the jar to a position at which the rim 7*a* is adjacent the bumper roll.

The overcap 1 serves to provide a tamper-proof protection of the integrity of the contents of the jar during the period between processing and purchase. To this end, by prevention of unauthorized tampering and removal of the closure cap 7 from the jar, the purchaser, as best as possible, is assured that adulteration of the contents, for example, through depletion, the introduction to the contents of foreign matter, or the breaking of the vacuum seal has not taken place.

The overcap 1 includes a body having an upper surface 8 and a skirt 9 depending circumferentially therefrom. The overcap 1 is formed of a plastic material which displays, preferably, characteristics among others of strength and durability in use and has limited elastic or stretch capability. Further, the plastic material is preferably constructed of smooth, slipper material or at least has an inner surface with these characteristics. Of the various plastics, polyethylene having a density of hardness within the range of about 0.955 to 0.965 grams per cubic centimeter and a melt index within the range of 14 to 20 is presently preferred. The melt index is measured in terms of grams of material melted per 10 minutes. With the preferred material, 14 to 20 grams of material can be melted in 10 minutes. For purposes of reducing the elastic nature of the plastic and thereby causing the body of the overcap to more readily fracture and tear upon both authorized and unauthorized removal from the jar, the melt index of the plastic material is preferably about 18 and the density about 0.960 which is considered to be high density.

To introduce sufficient flexibility for initially attaching the overcap onto the jar, the upper surface of the body is formed to an annular outline to provide an opening 10. The opening may vary in diameter from about 65 to 85% of the overall diameter of the upper surface of the overcap. As indicated, the higher the melt index, the less the nature of flexibility of the material of the body. If the melt index is set at 18, an opening 10 of a diameter of about 80% of the overall diameter of the upper surface will be sufficient to permit receipt of the overcap over the closure cap by snap action (to the FIG. 4 disposition) without fracture or tearing of the overcap during flexing. The overcap thereafter resides in relatively tight fit on the jar 2. The lower the melt index of the plastic material used, the smaller the opening to provide the same degree of flexibility or stretchability.

Figure 3:
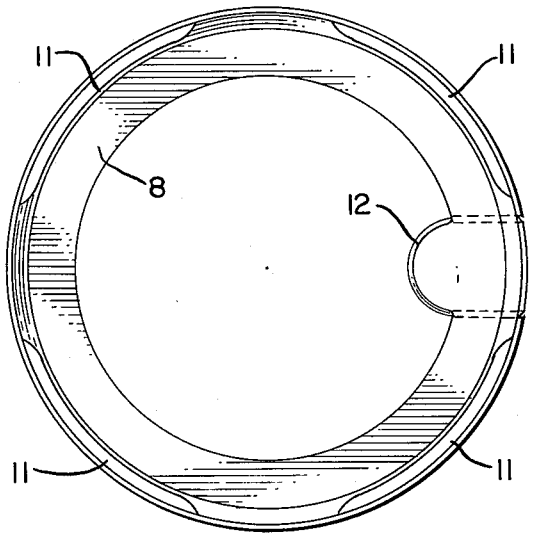
FIG. 3 is a bottom plan view of the overcap of FIG. 1.

A plurality of lip projections 11 in the form of ribs or ridges extend radially inwardly at the lower edge of the skirt. The skirt may include three or more lip projections and preferably four lip projections (see FIG. 3) spaced on 90° centers. Each lip projection has an overall length of about 60° arcuate degrees.

As seen in FIG. 4, the lip projections 11 are disposed in the region of the bumper roll 6 when the overcap is attached to the jar. The upper surface of each lip projection provides a generally flattened shoulder or abutment of sufficient surface area to cooperate under the rim 7*a* of the closure cap. The lower surface of each lip projection is inclined in a downward and radially outward direction so as to serve as a cam surface and permit the lip projections to cam over the rim of the closure cap upon placement on the jar. The shoulders react under the rim 7*a* during movement of the overcap in the disengaging direction; and because of the lack of stretchability of the body material, prevent such movement.

The overcap in elevation has an outline which substantially follows that of the closure cap 7. To this end, the annular portion 8 of the overcap generally lies in a plane parallel to the plane of the upper surface of the closure cap whereas the skirt portion 9 tapers generally outwardly from the circumferential edge of the annular portion. The inner diameter of the wall of the skirt at the circumferential edge of the annular portion exceeds the outer diameter of the wall of the closure cap to provide a radial clearance of about 0.002 to 0.003 inches (about 0.051 to 0.076 mm). The radial clearance along the length of the skirt increases toward the flattened shoulder of the lip projections so that the edge of the rib or ridge is spaced from the bumper roll by a maximum clearance of about 0.007 inches (about 0.179 mm). The upper radial clearance assists in preventing squeezing of the overcap to engage it with the closure cap below.

The strength and reduced elastic nature of the material of the body and the action of the plurality of lip projections against the bumper roll of the jar resists compressive forces and precludes movement of the skirt 9 toward and into frictional contact with the closure cap. Coupling of these members together is, therefore, prevented and the closure cap cannot be unthreaded without first removing the overcap. Normally, the overcap is free to be twisted relative to the closure cap 7 and the smooth, slippery nature of the overcap material acts to reduce the value of sliding friction which may develop if there be contact between the skirt and closure cap as an incident to gripping the overcap.

Figure 5:
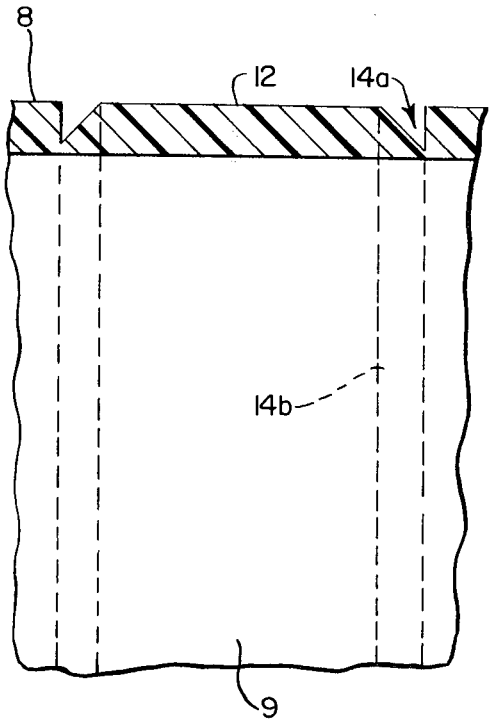
FIG. 5 is a partial vertical section as seen along the line 5—5 in FIG. 2.
Figure 6:
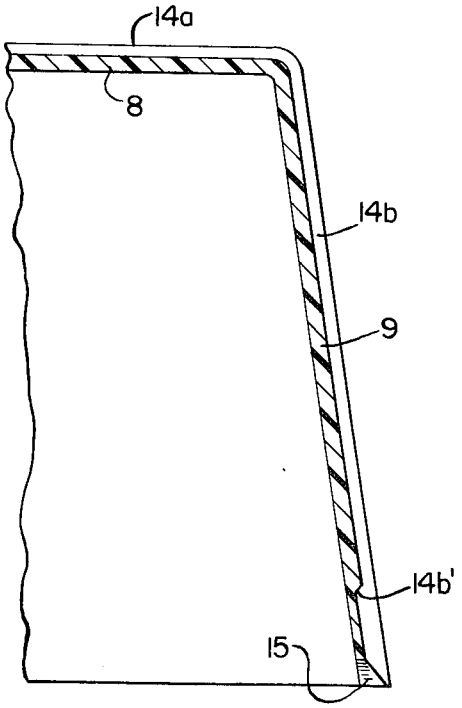
FIG. 6 is a vertical section as seen along the line 6—6 in FIG. 4.

The overcap may be broken away from the closure cap of the jar when it is desired to dispense the contents. To this end, the overcap includes a tab 12 which projects inwardly of the annular portion 8. The tab is formed integrally with the annular portion 8 and includes a knurled surface 13 within the upper surface of the projection to assist in gripping of the tab. A pair of parallel scores or grooves 14*a* are formed in the annular portion 8 to define the tab 12 and they continue as a pair of parallel scores or grooves 14*b* formed in the skirt portion 9. The scores, as seen in FIGS. 5 and 6, define a pair of lines along which the material of the overcap may easily fracture and break away from the closure cap. The scores may be formed in the body of the overcap through a separate scoring operation or during formation of the overcap as by molding. Similarly, the knurled surfacing to aid in gripping of the tab 12 may be applied in a separate operation or during the molding operation.

The scores may extend to a depth of approximately 75–80% of the thickness of the wall of the overcap substantially throughout the length of the scoring. The particular formation of the scores including the angle of the cut of about 45° to 60° as well as the reduced elasticity or flexibility of the body material assures that the overcap will fracture and break away from the closure cap in the event, for example, that an instrument is received under the skirt rim during any attempted unauthorized removal. However, to increase the protection against unauthorized removal, the scoring within the region 14*b'* preferably extends to a depth which is somewhat greater than the depth of the scoring in other regions. To this end, the scoring extends to a depth approximately 85–90% of the thickness of the wall throughout a length of about 0.16 inches (about 4mm) measured from the lower edge of the skirt 9. Further, a notch 15 providing additional weakness is formed in each score at the edge of skirt 9. The overcap, however, is not excessively fracture-prone and wil not fracture upon initial receipt on the jar over the closure cap even if the thickness of the wall is about 0.026 inches (0.66mm).

What is claimed is:

1. An overcap adapted for receipt on a container over a closure cap for said container and in surrounding relation with said closure cap to prevent unauthorized removal of said closure cap and opening of said container, said overcap comprising:

a. a body, said body including, 1. an upper surface adapted to overlie the top of the closure cap, and 2. a skirt depending circumferentially from the upper surface and adapted to encircle the closure cap, said skirt having an internal diameter which is greater than the external diameter of said closure cap to provide a radial space between said skirt and closure cap when the overcap is received on the container in surrounding relation with the closure cap to preclude frictional coupling of the overcap with the closure cap, said skirt further being formed of plastic, said plastic being relatively unyieldable to prevent movement of the skirt radially inwardly under compressive forces into surface-to-surface friction driving contact with said closure cap; and b. pull tab means carried by said body for tearing said body in a telltale manner to permit access to said closure cap.

2. The overcap of claim 1 further comprising:

a. ridge means carried by and directed inwardly of said skirt for cooperation with a surface of said container to maintain substantially constant said space between said closure cap and skirt so that said skirt is not in frictional contact with said closure cap.

3. The overcap of claim 2 wherein:

a. the skirt has a lower portion adapted to extend below the lower edge of the closure cap with which it is to be associated; and b. the ridge means is carried by the lower portion of said skirt and extends radially inwardly for disposition under the lower edge of the closure cap to prevent removal of said overcap from said closure cap.

4. The overcap of claim 3 further comprising:

a. means formed in said body providing areas of weakness along which said body will fracture away from said closure cap upon attempted removal of the overcap.

5. The overcap of claim 4 wherein:

a. said body is formed of plastic, said plastic being relatively unyieldable to resist movement of the skirt radially inwardly under compressive forces into surface-to-surface contact with said closure cap and to resist movement of said skirt outwardly past the lower edge of said closure cap once received thereon without fracture.

6. The overcap of claim 4 wherein:

a. the upper surface of said body is annular; and b. the pull tab extends radially inwardly of said annular surface.

7. The overcap of claim 6 wherein:

a. the inner diameter of said annular surface is in a range of about 65 to 85% of the overall diameter of said annular surface, the opening in said surface enabling said overcap to flex sufficiently for initial placement on said container.

8. The overcap of claim 7 wherein:

a. said body means includes a pair of score lines formed at least in said annular surface, said score lines extending across said annular surface from said pull tab and spaced apart by a distance substantially equal to the width of said pull tab.

9. The overcap of claim 7 wherein:

a. said pair of score lines extend across said skirt, the skirt score lines at least within the region furthest removed from said annular surface being cut to a greater depth than the scores within the annular portion.

10. The overcap of claim 9 whrein:

a. the ridge means includes a plurality of separate lips directed radially inwardly of the overcap and spaced circumferentially around said skirt; and b. each lip has a lower inclined surface for camming said skirt radially outwardly over the lower edge of the closure cap as the overcap is initially placed on the container and over the closure cap.

11. In combination with a container having a neck portion and a removable closure cap threadly received on said neck portion for closing said container, said closure cap having a top and depending skirt with a radially outwardly disposed rim adjacent the lower edge of said skirt; an overcap received over said closure cap to prevent unauthorized removal of said closure cap and opening of said container, said overcap comprising:

a. a body, said body including, 1. an annular surface, and 2. a skirt depending circumferentially from said surface, said skirt having a length extending below the rim of said closure cap and an internal diameter at least along a surface adjacent to said closure cap which is greater than the external diameter of said closure cap to provide a space between said skirt and closure cap;

b. means carried by and directed inwardly of said skirt for cooperation with the outside surface of said container to maintain substantially constant said space between said closure cap and skirt so that said skirt is not in frictional contact with said closure cap, said means further cooperating with the underside of said rim of said closure cap to prevent removal of said body over said closure cap once received thereon; and c. means carried by said body adapted to be grasped for manipulative breaking of said body from said closure cap in a telltale manner.

12. The overcap in combination with the container and closure cap according to claim 11 wherein:

a. the overcap is received over the closure cap in rotative relationship with respect to both the closure cap and container.

13. The overcap in combination with the container and closure cap according to claim 12 wherein:

a. the means carried by and directed inwardly of said skirt for cooperation with the outside surface of said container is located radially outwardly of the outside surface of the container for unobstructed axial movement relative thereto.

14. The overcap of claim 3 wherein:

a. the ridge means is disposed directly under the lower edge of the closure cap to prevent removal of the overcap and is also disposed radially outwardly of the outside surface of the container for unobstructed axial movement relative thereto.

* * * * *

UNITED STATES PATENT AND TRADEMARK OFFICE

CERTIFICATE OF CORRECTION

PATENT NO. : 3,952,901

DATED : April 27, 1976

INVENTOR(S) : Vincent N. Conti

It is certified that error appears in the above-identified patent and that said Letters Patent are hereby corrected as shown below:

Column 1, line 25, "on" should read --an--;

line 38, "tamperproof" should read --tamper-proof--.

Column 2, line 2, "of plastic" should read --of a plastic--;

line 26, "surfce" should read --surface--;

line 66, "a tamper-proof" should read --tamper-proof--

Column 3, line 16, "of hardness" should read --or hardness--;

Column 4, line 68, "wil" should read --will--.

Signed and Sealed this

Ninth Day of November 1976

[SEAL]

*Attest:*

RUTH C. MASON
*Attesting Officer*

C. MARSHALL DANN
*Commissioner of Patents and Trademarks*